US008864434B2

(12) United States Patent
Chiappini et al.

(10) Patent No.: US 8,864,434 B2
(45) Date of Patent: Oct. 21, 2014

(54) SYSTEM FOR MOVING OBJECTS IN A STOREHOUSE

(75) Inventors: Andrea Chiappini, La Spezia (IT); Gianluca Biselli, La Spezia (IT); Tonino Moricca, La Spezia (IT)

(73) Assignee: OTO Melara S.p.A., La Spezia (IT)

( * ) Notice: Subject to any disclaimer, the term of this patent is extended or adjusted under 35 U.S.C. 154(b) by 541 days.

(21) Appl. No.: 13/100,012

(22) Filed: May 3, 2011

(65) Prior Publication Data

US 2011/0268546 A1 Nov. 3, 2011

(30) Foreign Application Priority Data

May 3, 2010 (IT) ..... TO2010A0370

(51) Int. Cl.

| | |
|---|---|
| ***B66C 17/00*** | (2006.01) |
| ***B66C 13/04*** | (2006.01) |
| ***B66C 9/02*** | (2006.01) |
| ***B66D 3/18*** | (2006.01) |
| ***F41A 9/87*** | (2006.01) |

(52) U.S. Cl.

CPC . *F41A 9/87* (2013.01); *B66C 13/04* (2013.01); *B66C 9/02* (2013.01); *B66D 3/18* (2013.01)

USPC ..... 414/591; 212/319

(58) Field of Classification Search

CPC ..... B25J 15/0004; B25J 15/0052; B25J 15/0057; B25J 15/0061; B25J 9/0087; B25J 9/009; B25J 9/023; B25J 9/026; B66C 11/00; B66C 11/06; B66C 17/00; B66C 17/04; B66C 5/02; B66C 5/04; B66C 5/06; B66C 7/00; B66C 7/02; B66C 7/04; B66C 2700/01; B66C 2700/12; B66C 2700/14; B66C 2700/15; B66C 2700/18

USPC ..... 212/317, 318, 319; 414/226.02, 589, 414/590, 591, 749.3, 749.6, 751.1, 753.1; 901/16, 27, 30, 31, 36, 38, 39, 46

See application file for complete search history.

(56) References Cited

U.S. PATENT DOCUMENTS

| | | | | | |
|---|---|---|---|---|---|
| 3,527,268 | A | * | 9/1970 | Ginsburgh | 141/98 |
| 3,771,666 | A | * | 11/1973 | Fournier | 414/591 |
| 3,777,908 | A | * | 12/1973 | Keller | 414/267 |
| 3,973,683 | A | * | 8/1976 | Keller | 414/591 |
| 4,496,063 | A | * | 1/1985 | Ishii et al. | 212/270 |
| 4,557,135 | A | * | 12/1985 | Ragettli et al. | 72/420 |

(Continued)

FOREIGN PATENT DOCUMENTS

| | | |
|---|---|---|
| DE | 3642920 | 6/1986 |
| EP | 1898172 | 3/2008 |
| WO | 98/27397 | 6/1998 |

OTHER PUBLICATIONS

European Search Report dated Aug. 11, 2011.

*Primary Examiner* — Saul Rodriguez
*Assistant Examiner* — Brendan Tighe
(74) *Attorney, Agent, or Firm* — Merchant & Gould P.C.

(57) ABSTRACT

System for moving objects positioned in a closed space, includes at least one manipulator (3), adapted to grip and orient the objects in the desired positions and at least one overhead-travelling-crane mechanism (2), adapted to move said manipulator in the closed space in at least two different directions substantially horizontal.

An electronic processing unit, controlled by an operator, is able to electronically and automatically determine the movements of the overhead-travelling-crane mechanism and of the manipulator.

6 Claims, 3 Drawing Sheets

(56) References Cited

U.S. PATENT DOCUMENTS

| | | | | | |
|---|---|---|---|---|---|
| 4,815,845 | A * | 3/1989 | Colbaugh et al. | 356/153 |
| 4,949,277 | A * | 8/1990 | Trovato et al. | 700/255 |
| 5,166,679 | A * | 11/1992 | Vranish et al. | 340/870.37 |
| 5,363,051 | A * | 11/1994 | Jenstrom et al. | 324/661 |
| 5,626,458 | A * | 5/1997 | Bettinelli et al. | 271/249 |
| 5,716,187 | A * | 2/1998 | Costa | 414/751.1 |
| 6,485,285 | B1 * | 11/2002 | Shiotani | 425/139 |
| 7,044,706 | B2 * | 5/2006 | Jung | 414/737 |
| 7,461,753 | B1 | 12/2008 | Gatta et al. | |
| 8,365,386 | B2 * | 2/2013 | Vontz et al. | 29/464 |
| 8,365,389 | B2 * | 2/2013 | Taylor | 29/564.3 |
| 2010/0314346 | A1 * | 12/2010 | Tian | 212/317 |
| 2012/0213616 | A1 * | 8/2012 | Compton et al. | 414/273 |
| 2012/0286534 | A1 * | 11/2012 | Harada et al. | 294/213 |

* cited by examiner

SYSTEM FOR MOVING OBJECTS IN A STOREHOUSE

This application claims benefit of Serial No. TO 2010 A 000370, filed 3 May 2010 in Italy and which application is incorporated herein by reference. To the extent appropriate, a claim of priority is made to the above disclosed application.

BACKGROUND

The present invention refers to a system for moving objects in a storehouse. In particular, the present invention refers to a system for moving objects preferably elongated, such as for instance, projectiles arranged in a storehouse, which must be made available for a firearm magazine. This magazine can be a magazine for firearms positioned on military means, or in fixed positions, whereas the projectiles are housed into a storehouse, similar to a deposit under the arm, such as for instance the hold of a ship.

In one of its preferred embodiments the system is adapted to control, the loading and the unloading of the ammunitions, from/to the loading drums and from/to the lift of ammunitions exchange among the ship decks, for a naval complex.

In these technical solutions, the ammunition or projectile must be quickly brought from the hold of the ship, or in general from the ammunition storehouse towards the magazine, for instance a drum magazine, which must always contain at least a predetermined number of projectiles. Therefore, a very important parameter for the efficiency of an entire system, is the speed with which the moving systems determine the availability of the projectile toward the magazine. Sometimes the handling of the projectiles is manually made, but due to the huge size of the ammunitions, the handling and the loading are often made in a semi-automatic way through the aid of motorized carriages.

The prior art solutions do not provide for an efficient interaction between the operator and the automatic drawing and handling mechanisms of the projectiles.

SUMMARY

The present invention proposes to solve these issues by suggesting a system for moving objects positioned in a closed space, such as for instance a storehouse of projectiles which must be made available for a firearm magazine associated to this storehouse, comprising at least a manipulator adapted to grip and orient the mentioned objects in the desired positions, at least one overhead-travelling-crane mechanism adapted to move this manipulator in at least two different directions substantially horizontal, a processing unit, controlled by an operator, which is able to automatically determine the movements of the overhead-travelling-crane mechanism and of the manipulator.

An aspect of the present invention relates to a system for moving projectiles for a firearm magazine.

BRIEF DESCRIPTION OF THE DRAWINGS

The characteristics and advantages of this system will be clearer and evident from the following description of an embodiment with reference to the attached figures which schematically show.

DETAILED DESCRIPTION

Figure 1:
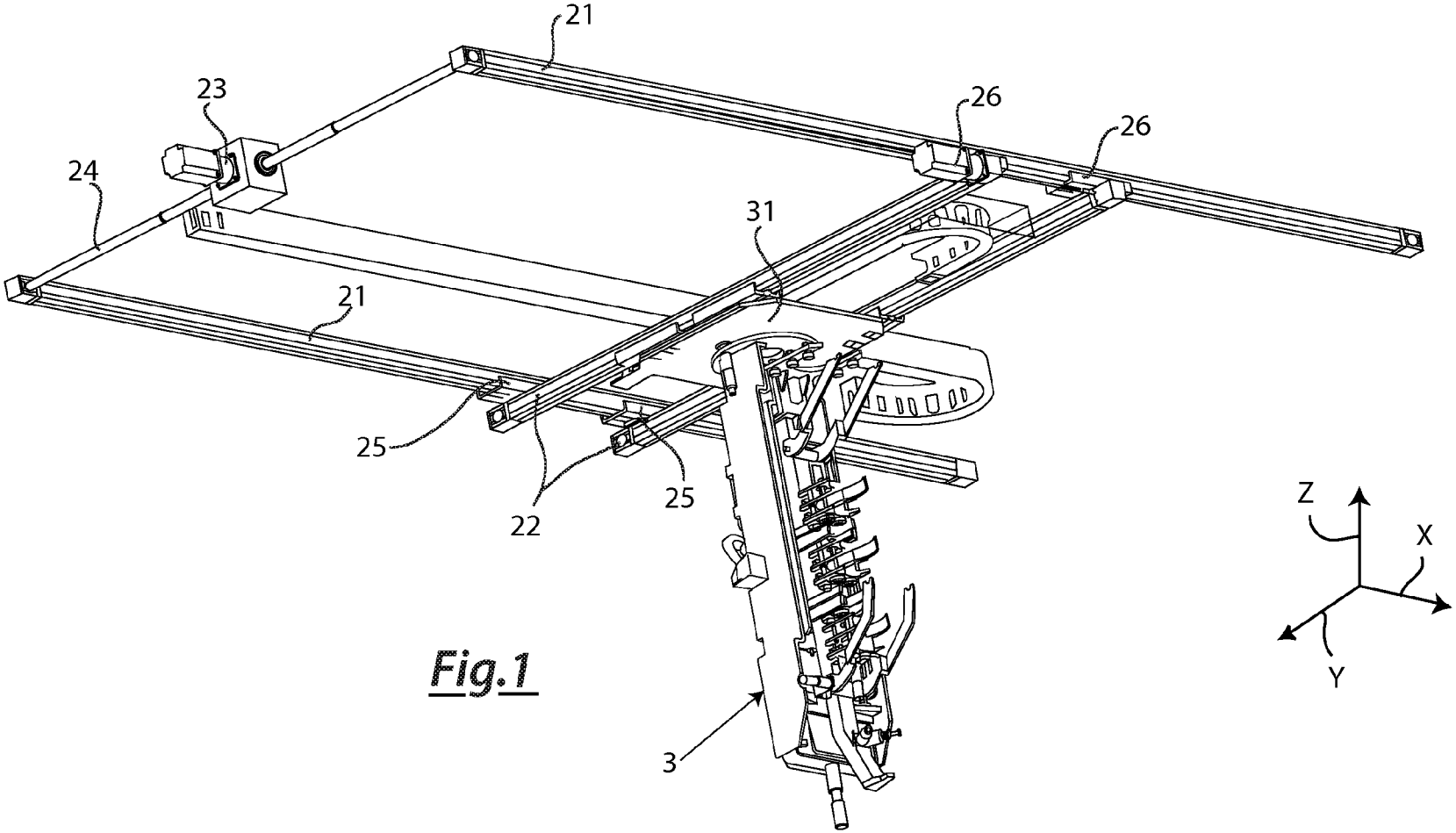
FIG. 1, the structure of the moving system in its entirety according to the present invention.
Figure 2:
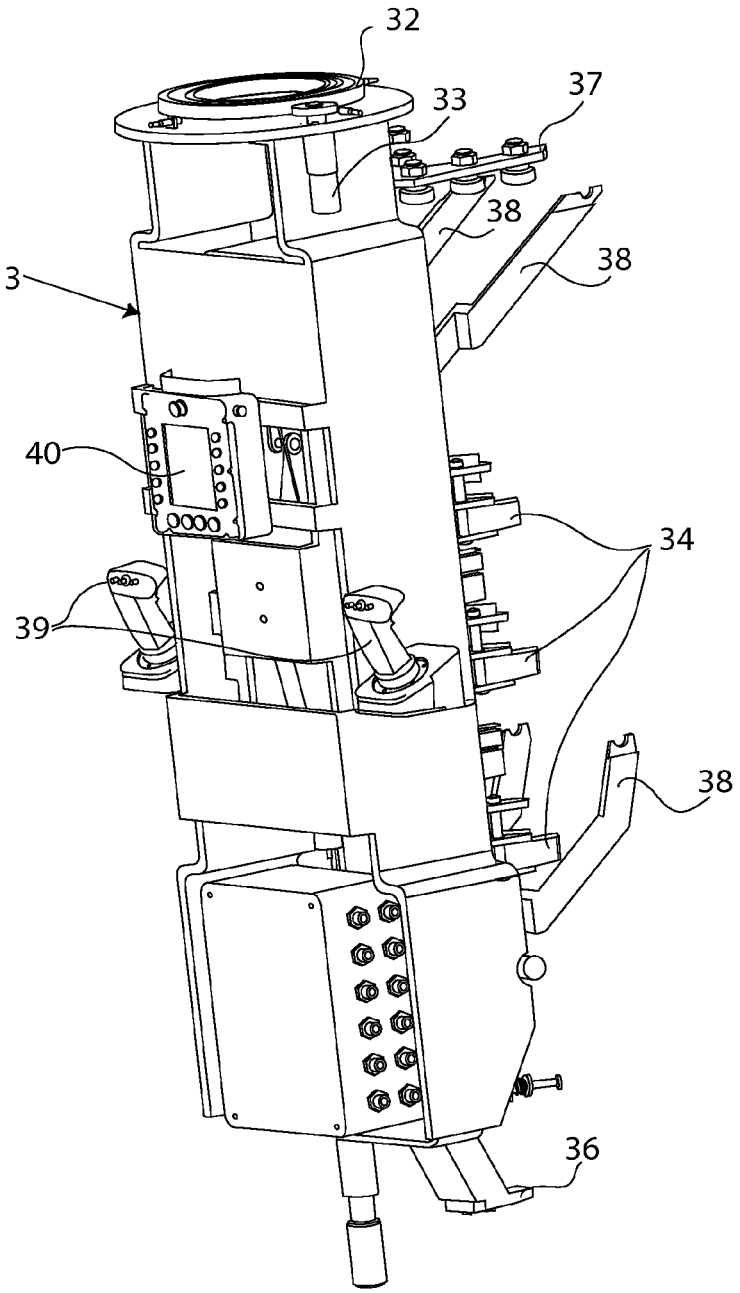
FIG. 2 the structure of the manipulator from a front perspective view according to the present invention.
Figure 3:
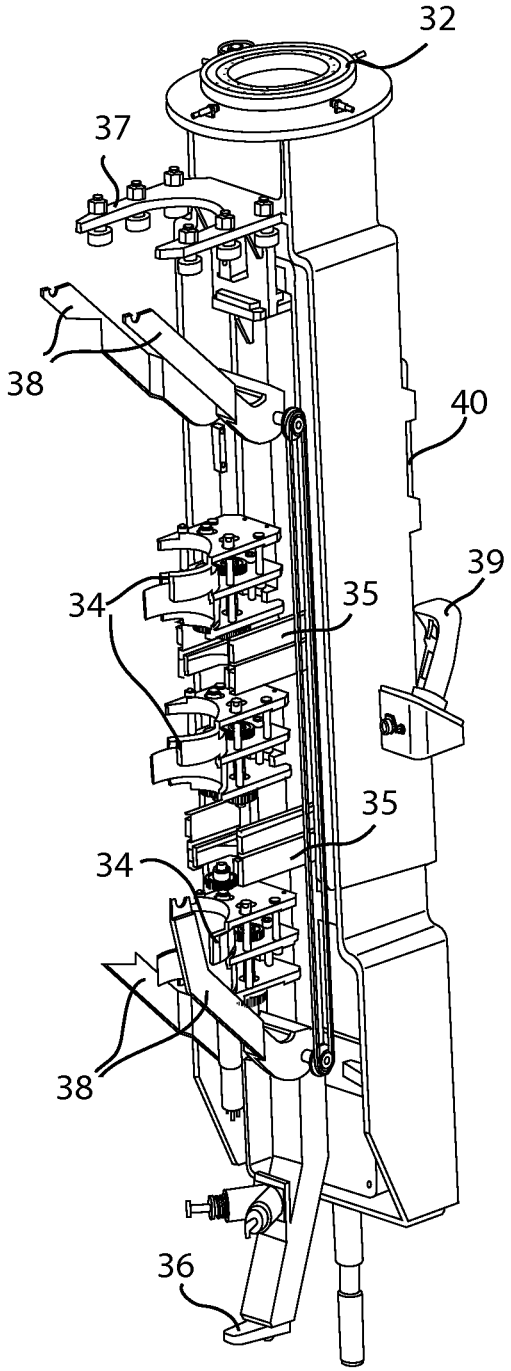
FIG. 3 the structure of the manipulator from a rear perspective view according to the present invention.

With reference to the above mentioned figures, the moving system according to the present invention comprises at least a manipulator 2, adapted to grip and orient the objects in the desired positions, associated to an overhead-travelling-crane mechanism 3, adapted to move this manipulator in a storehouse where the objects are placed. The manipulator is automatically controlled by an operator through an electronic processing unit associated to it.

The objects are preferably elongated objects and in a preferred embodiment are projectiles, arranged in a storehouse which must be made available for a firearm magazine. The arm is usually arranged above the storehouse, for instance it occurs in a hold of a ship. However, more generally, the system according to the present invention, could be used, with suitable changes, in any field wherein the handling of particular objects is necessary.

The overhead-travelling-crane mechanism basically comprises at least one pair of longitudinal guides 21 sliding on which there is at least one pair of transverse guides 22, on which manipulator 3 in turn slides. To the longitudinal guides is associated at least a longitudinal motor, adapted to move the transverse guides along the longitudinal axis X of the guides. In the shown form of embodiment, said motor 23 is arranged between the two guides 21 and transmits the movement to the transverse guides, through a driving shaft 24, which activates a toothed belt mechanism arranged inside the guides. This toothed belt mechanism is constrained to a pair of carriages 25, which slide in the longitudinal guides and which are fixed to the opposed ends of the transverse guides, drawing them in the sliding movement along the longitudinal axis X.

To transverse guides 22 is associated at least a transverse motor, adapted to move the manipulator along transverse axis Y of the guides. In the shown embodiment, transverse motors 26 are two, arranged each one at an end of one of the two transverse guides, which through a toothed belt mechanism draw the manipulator along the above mentioned transverse guides. To this purpose, the manipulator comprises a sliding plate 31, which proceeds on the transverse guides and which is associated to this toothed belt mechanism.

The manipulator comprises an elongated body, constrained to sliding plate 31 by means of a circular joint 32 that enables the rotation of the manipulator about its vertical axis Z, for its correct orienting. Preferably, this rotation is produced through a rotation actuator 33, arranged under the joint.

The manipulator comprises also gripping means for one object, comprising a plurality of pliers 34 that can be moved by means of suitable servo-motors electronically controlled, along the longitudinal axis of the manipulator, for instance through linear guides 35, so as to enable the gripping of objects of different sizes. In particular, in the shown embodiment, the guides permit also to vertically align the drawn projectile to the magazine, for instance to one of the drums. Positioning means comprising a bottom resting plate 36 and a top guiding device 37, enable the resting and the proper positioning of the objects in the manipulator.

In the embodiment of the system wherein the objects are projectiles, the manipulator is provided also with a pair of movable forks 38 adapted to permit the drawing of the projectiles from the corresponding crates in which they are positioned. As a matter of fact, through these forks opportunely electronically controlled by servo-motors, it is possible to move these crates.

The manipulator is also provided with proximity sensors adapted to avoid its unexpected contact with the objects. All the movements of the system are then movements along axis X and Y of the overhead-travelling-crane mechanism, movements of rotation about the longitudinal axis of the manipulator, movements along the longitudinal axis of the manipulator of telescopic guides 35, opening and closing of pliers 34, movement of forks 38, are electronically controlled by a processing unit in an automatic way, through the remote control of an operator which interfaces said processing unit, for instance by means of a personal computer. The system provides also for a semi-automatic mode wherein the manipulator has an access interface for the operator comprising a control joystick 39 provided with control pushbuttons and eventually a checking display 40, which can also be provided with pushbuttons. In this way, the operator can directly determine and follow the movements and the operations of the manipulator in the storehouse. The system results to be deeply different with respect to the known systems, which being completely manual do not properly satisfy the needs quickness of the operations and the obvious need for arranging a certain number of operators. During the maintenance steps or in exceptional conditions, the manipulator is expected to be manually controlled, by means of the aforesaid interface. It is also directed to the safety of the operator required to work in adverse environmental conditions.

The invention claimed is:

1. System for moving objects positioned in a closed space, comprising:

at least one manipulator having a longitudinal axis, adapted to grip and orient the objects in desired positions; the manipulator comprising:

means for gripping one of said objects including a plurality of pliers movable along the longitudinal axis of the manipulator, the pliers being moved by linear telescopic guides to enable gripping objects of different sizes;

a positioning assembly including a bottom resting plate and a top guide device configured for enabling resting and positioning of the objects in the manipulator;

a pair of movable forks configured for permitting drawing an object positioned in a closed space;

at least one overhead-travelling-crane mechanism, adapted to move said manipulator in said closed space in at least two different substantially horizontal directions, an electronic processing unit, controlled by an operator, the electronic processing unit being able to determine electronically and automatically movements of the overhead-travelling-crane mechanism and of the manipulator.

2. System according to claim 1, wherein the overhead -crane mechanism comprises at least one pair of longitudinal guides sliding on which is at least one pair of transverse guides, on which the manipulator slides.

3. System according to claim 1, wherein the manipulator comprises a sliding plate, which proceeds on transverse guides, and an elongated body constrained to the sliding plate by a circular joint that enables rotation of the manipulator about its longitudinal axis.

4. System according to claim 1, wherein the manipulator has an access interface for the operator comprising a control joystick equipped with control pushbuttons to enable an operator's direct control, the operator being able to determine and follow movements of the manipulator in the closed space.

5. System according to claim 4, wherein the manipulator comprises a checking display equipped with control pushbuttons.

6. System according to claim 1, wherein the manipulator is provided with proximity sensors adapted to prevent its unexpected contact of the manipulator with objects.

* * * * *